United States Patent [19]

Lonon

[11] Patent Number: 5,003,637

[45] Date of Patent: Apr. 2, 1991

[54] GLOVES WITH UTILITY ATTACHMENTS

[76] Inventor: Edward M. Lonon, 155 Sanford St., East Orange, N.J. 07018

[21] Appl. No.: 115,208

[22] Filed: Feb. 1, 1988

[51] Int. Cl.[5] ..... A41D 19/00

[52] U.S. Cl. ..... 2/160; 2/249; 2/250; 224/903

[58] Field of Search ..... 2/160, 161 A, 161 R, 2/244, 247, 249, 248-253; 224/903

[56] References Cited

U.S. PATENT DOCUMENTS

| | | | |
|---|---|---|---|
| 1,416,653 | 5/1922 | Lenneberg | 224/903 X |
| 2,103,711 | 12/1937 | Cole | 224/903 X |
| 2,333,428 | 11/1943 | Kinsey | 2/160 |
| 2,432,325 | 12/1947 | McDougall | 2/160 |
| 3,438,062 | 4/1967 | Dobell | 2/247 |
| 3,484,974 | 12/1969 | Culmone | 2/DIG. 6 |
| 3,611,444 | 12/1969 | Rector | 2/247 |
| 4,247,097 | 1/1981 | Schwartz | 2/160 |
| 4,330,120 | 5/1982 | Netti | 2/160 |
| 4,370,696 | 1/1983 | Darrell | 2/160 |
| 4,387,838 | 6/1983 | Jackson | 2/160 |
| 4,651,355 | 3/1987 | White | 2/247 |
| 4,682,310 | 7/1987 | Lund et al. | 224/903 X |
| 4,761,835 | 8/1988 | Chen | 2/160 |
| 4,766,611 | 8/1988 | Kim | 2/160 |
| 4,862,521 | 9/1989 | Mann | 224/903 X |

FOREIGN PATENT DOCUMENTS

| | | | |
|---|---|---|---|
| 2612051 | 9/1988 | France | 2/168 |

OTHER PUBLICATIONS

Maurice Gershman, "Self Adhering Nylon Tapes," The Journal of the American Medical Association, vol. 168, No. 7, p. 930, dated: Oct. 19, 1958.

*Primary Examiner*—Werner H. Schroeder
*Assistant Examiner*—Jeanette E. Chapman

[57] ABSTRACT

This relates to gloves, to the external back surfaces of which a utility attachment, such as a container for cigarettes, driver's license, credit cards, pens, pencils, comb, mirror, watch, radio, first aid equipment, or the like, or a decorative figure or symbol, may be removablay attached.

2 Claims, 4 Drawing Sheets

GLOVES WITH UTILITY ATTACHMENTS

BACKGROUND OF THE INVENTION

This relates in general to gloves having utility attachments which would enable the wearer to attach to the outside of the glove various items, such as a container for change, cigarettes, driver's license, pens or pencils, comb, mirror, watch, radio, first-aid equipment, calculator or similar items, or a decorative figure or symbol.

It is difficult in cold weather when one is wearing gloves to reach inside of clothing and into a pocket or purse for retrieving any of the items mentioned above.

SHORT DESCRIPTION OF THE INVENTION

Accordingly, it is the principal object of the present invention to provide greater convenience for persons dressed for cold weather or using work gloves to carry and retrieve small objects of a type usually carried in the pocket or purse, or hand.

This and other objects are provided in accordance with the present invention by a small pocket or container which may be removably fastened to the external back surface of a glove by a synthetic material sold in pieces or strips comprising complemental parts which adhere when pressed together. This is sold under the registered trademark 'VELCRO' ®, which is manufactured by American VELCRO Inc. of Manchester, N.H. VELCRO ® or the like, is applied to the back of the container and the outer surface of the glove. This enables the container or device to be applied, removed and replaced at will. The container may be shaped to hold any of a number of utilitarian objects such as cigarettes, mirror, comb, compact, lipstick, pens and pencils, first aid kit, radio, calculator, driver's license and the like. Moreover, a watch or decorative item or symbol may be attached also, by flaps backed by adhesive material such as VELCRO ®, to the upper surface of the container or to the upper surface of the glove.

In a similar manner, certain of the items, such as a watch, or radio, may be applied directly to the external back surface of the glove by the use of matching patches of VELCRO ® or similar material.

This has the advantage of making various utilitarian items immediately available to persons wearing gloves without the inconvenience of carrying a purse or container, or radio in an inside pocket, or a watch on the arm which is only accessible if the outer clothing is opened and the glove removed.

These and other objects, features and advantages will be better understood by a study of the detailed description hereinafter with reference to the attached drawings.

SHORT DESCRIPTION OF THE DRAWINGS

DETAILED DESCRIPTION OF THE INVENTION

Figure 1:
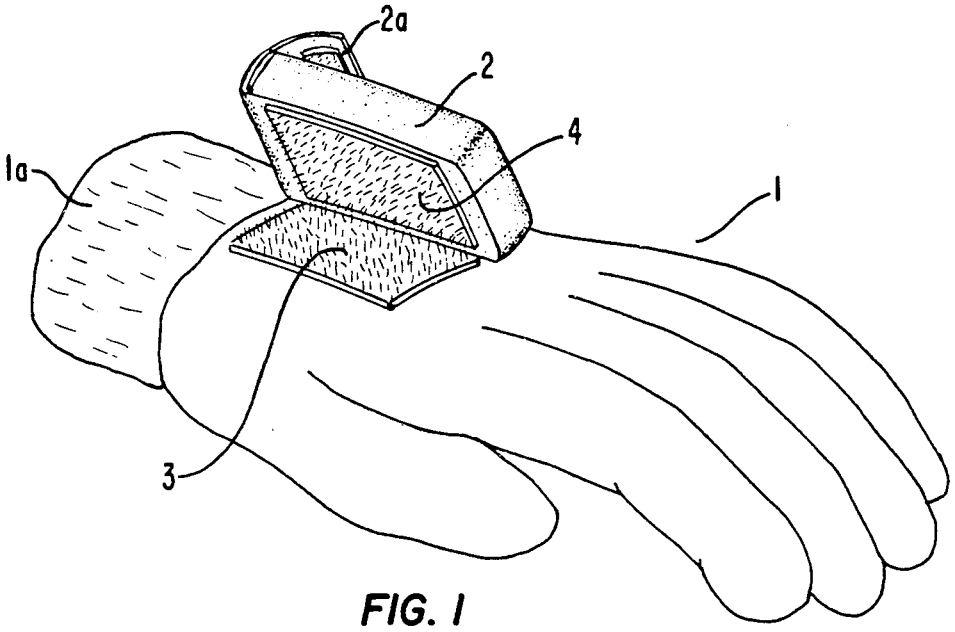
FIG. 1 shows a lateral perspective view of a utility container of the type contemplated by this invention in the process of being attached to the surface of a glove by VELCRO ® adhesive surfaces on the underside of the container and the outer surface of the glove.

Referring to FIG. 1 of the drawings, there is shown a glove 1 having a cuff 1*a* mounted on the hand of a wearer.

Sewn, or otherwise secured on the outside of the glove 1, just below the cuff 1*a*, is a rectangular patch, say, 1½ inches wide and 2 inches long, of a material sold under the registered trademark VELCRO ® by American VELCRO Inc. of Manchester, N.H. This comprises a synthetic material sold in pieces or strips comprising complementary parts which strongly adhere to one another when pressed together, and which, with some effort, may be pulled apart.

A small rectangular container 2 of, for example, cloth or leather, say, 3½ inches long, 2½ inches wide and 1-½ inches deep, has a closure 2*a* which overlaps the top. It will be understood that the dimensions are for illustration only, and that the container 2 may be of any size which can be fitted comfortably to the top surface of the glove without interfering with the movement of the fingers.

To the under surface of the container 2 is sewn, or otherwise secured, a patch of VELCRO ® material which substantially matches the size and shape of the VELCRO ® patch 3 on the surface of glove i, and to which it is designed to adhere to fasten the container 2 to the surface of glove 1. The flap 2*a* may be closed in secured relation to the outer surface of container 2 by matching strips of VELCRO material, or by snaps, as described hereinafter with reference to FIG. 6.

It will be understood that the container 2 may be shaped or adapted to hold any of a number of different utilitarian objects, such as a compact, comb, lipstick, calculator, credit cards, small radio, etc.

Figure 2:
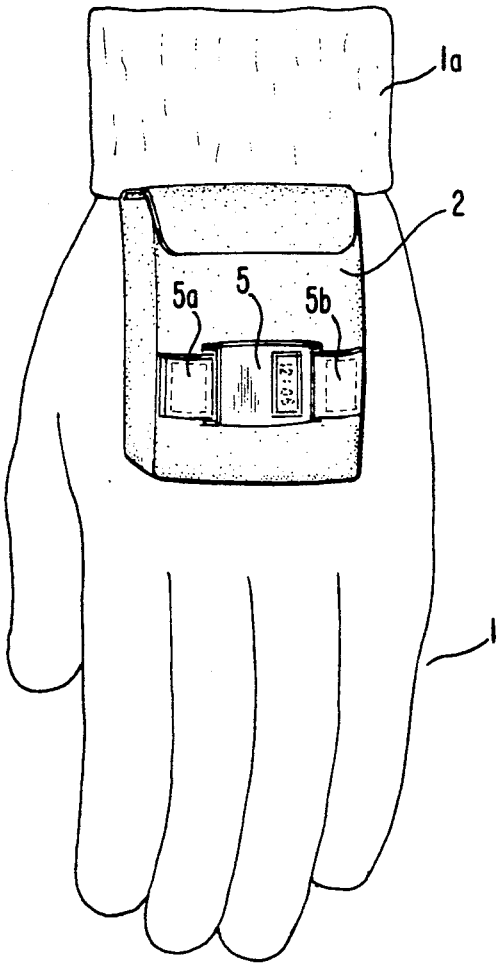
FIG. 2 shows a top view of the container of FIG. 1 fully attached to the glove surface, a watch being attached to the outer surface of the glove.
Figure 3:
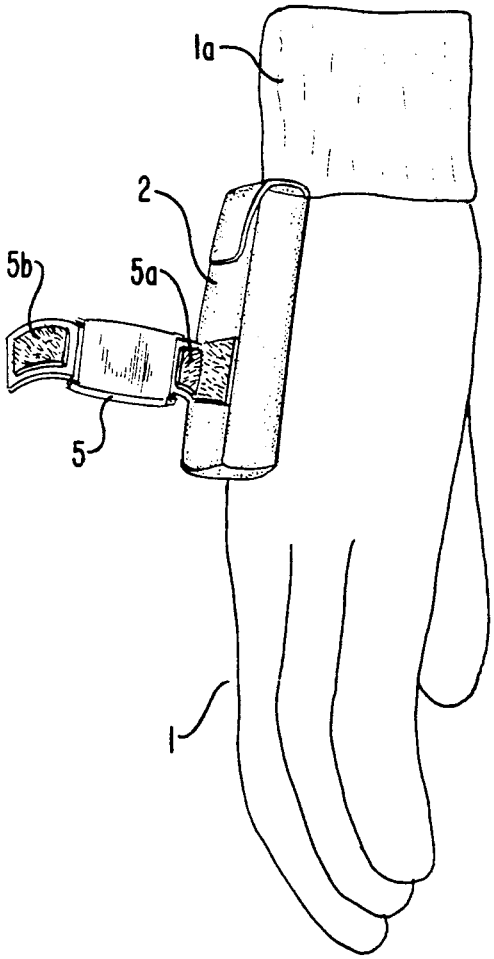
FIG. 3 is a side perspective view of the glove combination of FIG. 2 with the container and watch fully attached.

Moreover, a watch may be carried inside of the pocket 2, or, as shown in FIGS. 1, 2, and 3, may be attached to the outside, in the manner of watch 5. The latter has a pair of lateral tabs 5*a* and 5*b* extending out from opposite sides, to the underside of each of which is attached a patch of VELCRO ® material, or the like, say, one inch square which mates with a similar patch of VELCRO ® material sewn or otherwise affixed to the upper surface of container 2.

Figure 5:
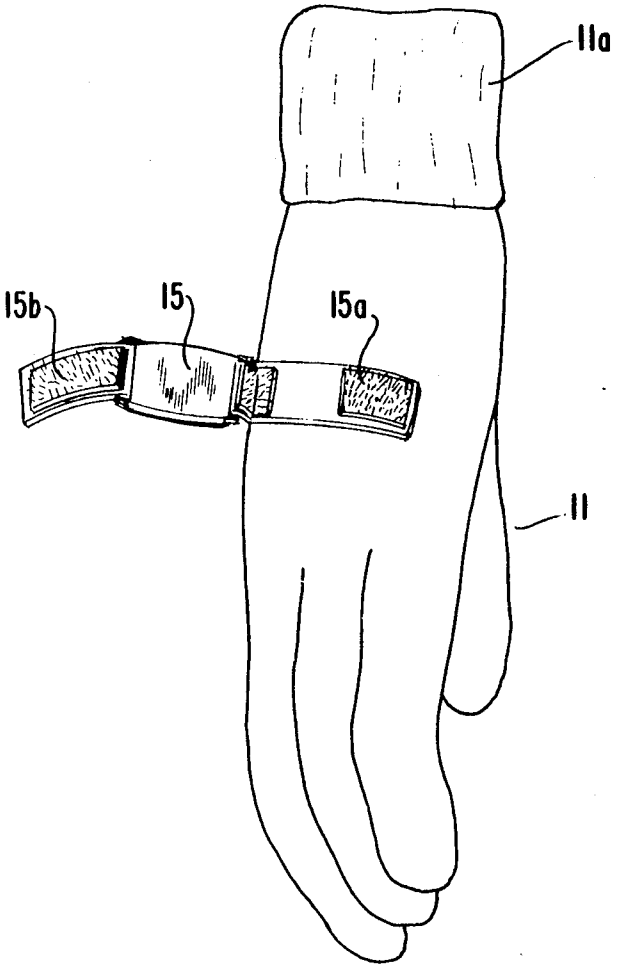
FIG. 5 is a lateral perspective view of a glove with a watch being attached to the outer surface by a VELCRO ® attachment.
Figure 4:
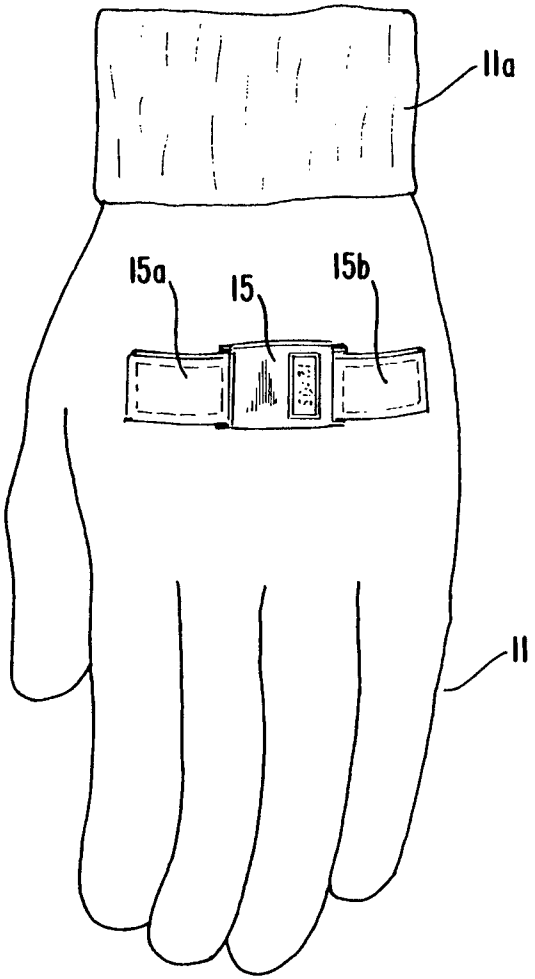
FIG. 4 shows the combination of FIG. 4 with the watch fully in place on the glove surface.

In a similar manner, as shown in FIGS. 4 and 5, a watch 15 may be removably adhered by a pair of VELCRO ® tabs, or the like, to similar VELCRO ® patches on the outer surface of glove 11.

Figure 6:
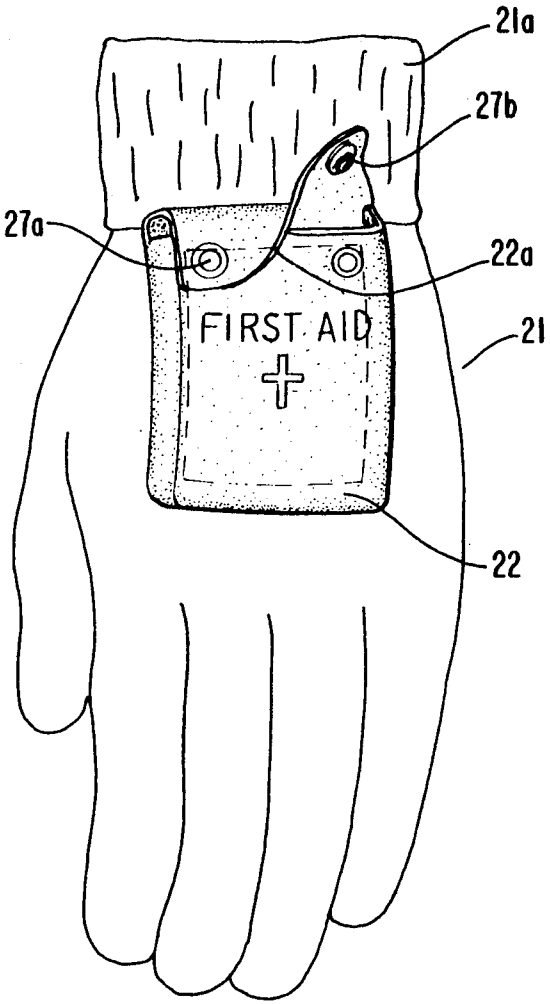
FIG. 6 shows a first aid kit having a snap closure attached to the outer surface of the glove in the manner of Figs. 1 and 2.

In addition, the container 2 may be designed to hold a small first aid kit or other medical device, such as a stethoscope, or medical identification card, such as may be used by diabetics or heart patients. Such a container is shown in FIG. 6, in which a rectangular container 22, closed in a flap 22*a* having snaps 27*a* and 27*b*, is secured by VELCRO® adherent to the surface of an ordinary glove 21.

Figure 8:
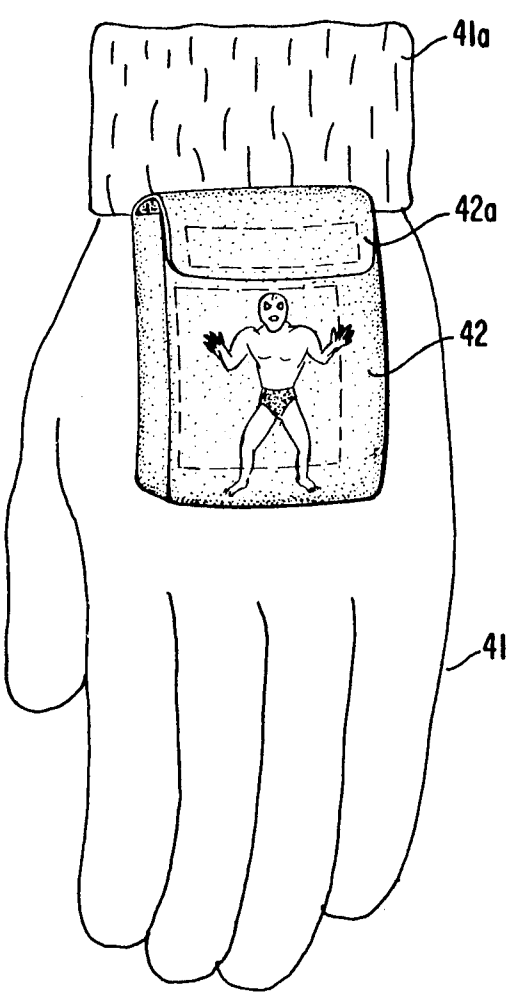
FIG. 8 shows a container for cigarettes, calculator, radio or the like, having a VELCRO ® closure, and attached to the glove surface in the manner of FIG. 1. A symbolic figure is attached to the outer surface of the container.
Figure 7:
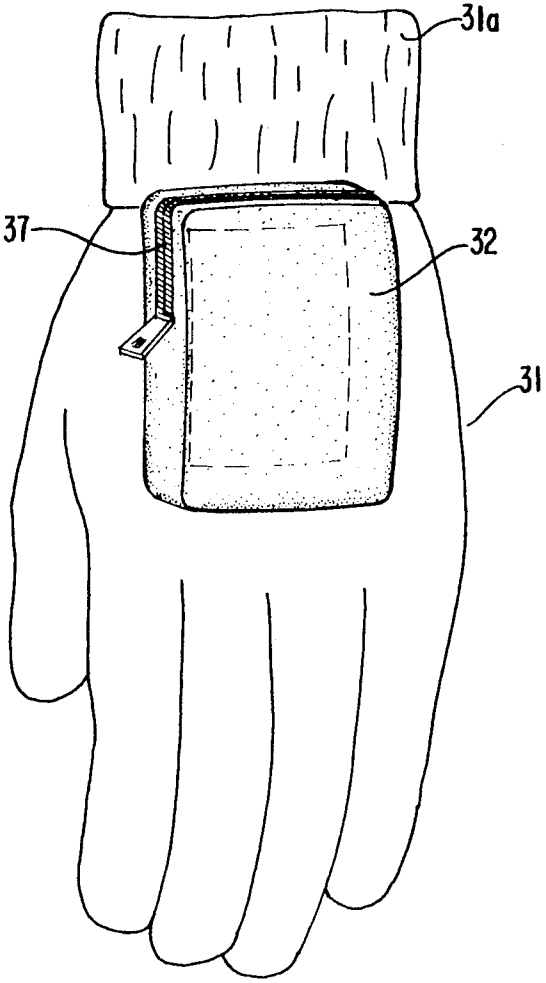
FIG. 7 shows a container of cigarettes, a radio or the like, having a zipper closure, attached to the outer surface of a glove in the manner of FIG. 1.

Other modifications are shown in FIGS. 7 and 8.

FIG. 7 shows a container 32 closed by a zipper 37. The rectangular container 32 is secured to the surface of the glove 31 by a VELCRO® adherent in the same manner as shown and described with reference to FIGS. 1–3, hereinbefore.

FIG. 8 shows a container 42 connected to the outer surface of the glove 41 by VELCRO® material or the like, in the same manner as indicated in FIGS. 1–3, 6 and 7, and having a symbol 49 attached to the outer surface permanently, by being sewn or riveted or by VELCRO® material or similar adherent, as previously discussed. Instead of the symbol 49, as shown, this could take the form of school letters, team designations, or any desired types of marks or symbols.

Figure 9:
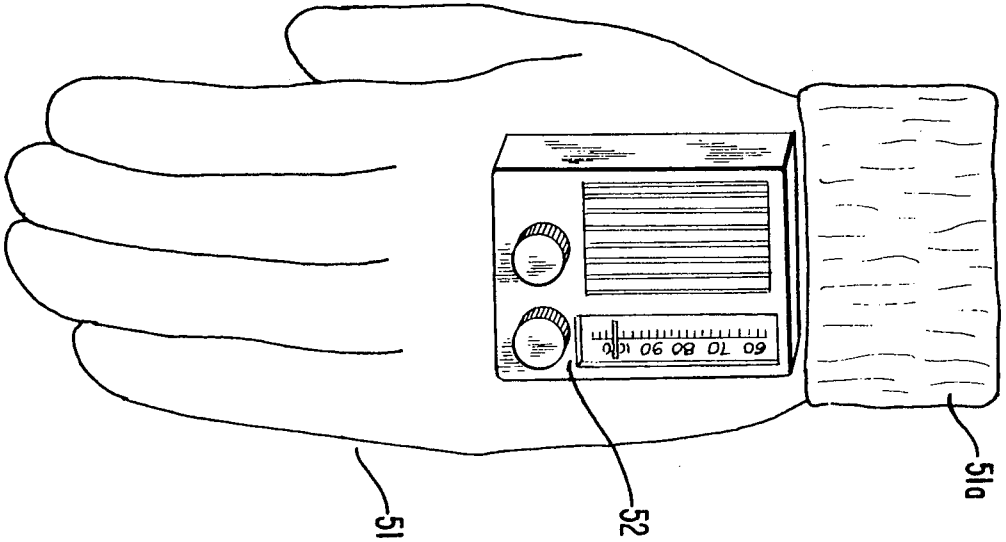
FIG. 9 shows a glove, having a small radio fixed directly to its external rear surface by patches of VELCRO ® or similar material.

FIG. 9 shows a further modification in which a small radio 52, having a patch of VELCRO® material fastened to its rear surface, is adhered directly to a matching patch of VELCRO® material on the exernal back surface of the glove 51, in the manner shown in FIGS. 1, 2 and 3.

It will be understood that the invention is not limited to the examples shown by way of illustration, but only by the scope of the appended claims.

What I claim is:

1. A glove comprising in combination a utility attachment;

means for removably applying said utility attachment to the external back surface of said glove, which is constructed to overlie a back of a user's hand, which means comprises in combination a pair of complemental parts of hook and loop fasteners, which adhere when pressed together, one of the parts of said pair being sewn or otherwise secured to the external back surface of said glove, and the other part of said pair being sewn or otherwise secured to a rear surface of said utility attachment, wherein said utility attachment is a hollow container formed from a sheet of flexible material, said container being constructed and arranged to hold one or more of the following items:

cigarette pack, comb, compact, lipstick, nail file, driver's license, medical card, first aid kit, radio, calculator, watch, change purse, wherein a watch is secured to the outside surface of said container.

2. The combination in accordance with claim 1 wherein sewn to or otherwise secured to an outside surface of said container is one of a pair of complemental parts of hook and loop fasteners and said watch having connecting straps;

at least another of said pair of complemental parts fixed to said connecting straps, whereby said watch is removably secured to the outside surface of said container.

* * * * *